United States Patent [19]

Bennett

[11] Patent Number: 5,045,083

[45] Date of Patent: Sep. 3, 1991

[54] LIGHT-FAST DYEING OF SYNTHETIC POLYAMIDE FIBERS: ANIONIC DYE, OXAZOLO-ANILIDE AND A COPPER COMPLEX

[75] Inventor: Brian Bennett, Bradford, Great Britain

[73] Assignee: Sandoz Ltd., Basle, Switzerland

[21] Appl. No.: 483,197

[22] Filed: Feb. 22, 1990

[30] Foreign Application Priority Data

Feb. 22, 1989 [GB] United Kingdom ..... 8904015
Mar. 1, 1989 [GB] United Kingdom ..... 8904645

[51] Int. Cl.[5] ..... D06P 1/39; D06P 3/24; D06P 5/06

[52] U.S. Cl. ..... 8/442; 8/586; 8/599; 8/600; 8/624; 8/680; 8/685; 8/924

[58] Field of Search ..... 8/442, 586

[56] References Cited

U.S. PATENT DOCUMENTS

| | | | |
|---|---|---|---|
| 4,412,024 | 10/1983 | Avar et al. | 252/402 |
| 4,544,691 | 10/1985 | Dexter et al. | 524/99 |
| 4,613,334 | 9/1986 | Thomas et al. | 8/442 |
| 4,704,133 | 11/1987 | Reinert et al. | 8/442 |
| 4,707,161 | 11/1987 | Thomas et al. | 8/442 |
| 4,775,386 | 10/1988 | Reinert et al. | 8/442 |
| 4,813,970 | 3/1989 | Kirjanov et al. | 8/442 |
| 4,874,391 | 10/1989 | Reinert | 8/442 |
| 4,902,299 | 2/1990 | Anton | 8/442 |

FOREIGN PATENT DOCUMENTS

| | | |
|---|---|---|
| 252386 | 1/1988 | European Pat. Off. . |
| 261821 | 3/1988 | European Pat. Off. . |
| 57-005987 | 1/1982 | Japan . |
| 1234128 | 6/1971 | United Kingdom . |
| 1362957 | 8/1974 | United Kingdom . |

OTHER PUBLICATIONS

Organic Sequestering Agents—Chabarek and Martell—John Wiley and Sons (1959), pp. 306-315.
Kirk-Othmer 23, pp. 615-627.
Chemical Abstracts 87:202974c.

*Primary Examiner*—A. Lionel Clingman
*Attorney, Agent, or Firm*—Gerald D. Sharkin; Richard E. Vila; Thomas C. Doyle

[57] ABSTRACT

The present invention relates to a process for dyeing polyamide comprising a) one or more oxanilide U.V. absorbers (hereinafter defined as component a);
b) one or more copper complexes, (hereinafter defined as component b); and
c) one or more metal-free or metallized acid dyes in particular 1:2 metal complex dyes (hereinafter defined as component c) optionally together with one or more dyeing assistants.

39 Claims, No Drawings

LIGHT-FAST DYEING OF SYNTHETIC POLYAMIDE FIBERS: ANIONIC DYE, OXAZOLO-ANILIDE AND A COPPER COMPLEX

The present invention relates to dyed polyamide fibres having good fastness and stability to heat and light.

Good light fastness of fibres dyed with metallised acid dyes and good stability to heat and light can be obtained by treating the fibres with copper compounds. However, for certain end uses, e.g. automobile fabrics, a very high degree of fastness to light (of the dyes) and stability to light is desired.

To obtain polyamide dyeings with good light fastness and polyamide that has a good stability to light, there is provided according to the invention a process for dyeing polyamide comprising, applying to the polyamide, a) one or more oxanilide U.V. absorbers (hereinafter defined as component a);

b) one or more copper salts and/or complexes, (hereinafter defined as component b); and c) one or more metal-free acid dyes and/or metal complex dyes [preferably 1:2 metal complex dyes] (hereinafter defined as component c) optionally together with one or more dyeing assistants.

Preferably component b) is copper complex of a complexing agent having $K_{MA}$-value of 1.5 to 20.

Preferably $K_{MA}$ is 1.5 to 8.

Preferably the total amount of components a) and b) present is 0.2 to 2.0% based on the weight of polyamide present.

Preferred metal complex dyes are the metallised acid dyes (preferably 1:2 metal complex dyes).

Preferred copper salts and complexes are those selected from a copper complex of α-hydroxy-$C_{2-6}$alkylene carboxylic acids, preferably those copper complexes of citric acid, gluconic acid, tartaric acid, glycollic acid and saccharic acid.

Preferred oxanilides are compounds of formula I

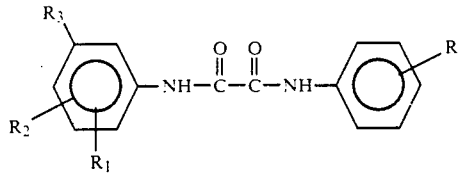

(I)

in which $R_1$ and $R_2$ independently are selected from hydrogen, $C_{1-12}$alkyl, $C_{1-12}$alkoxy, $C_{1-12}$alkylthio, phenoxy or phenylthio; (preferably provided that $R_1$ and $R_2$ may not both be selected from alkylthio, phenoxy and phenylthio);

$R_3$ is hydrogen or $C_{1-8}$alkyl; (preferably hydrogen); and

R is hydrogen or $C_{1-12}$alkyl or $C_{1-12}$alkoxy.

Preferred compounds of formula I are those of formula Ia

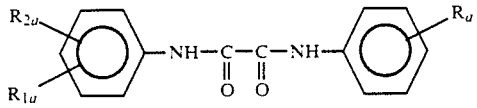

(Ia)

in which $R_{1a}$ is ethoxy or methoxy;

$R_{2a}$ is hydrogen or $C_{1-4}$alkyl (more preferably $R_{2a}$ is $R_{2a}$, where $R_{2a}$, is hydrogen or tertiary butyl); and $R_a$ is hydrogen or $C_{1-4}$alkyl (more preferably $R_a$ is $R_a$, where $R_a$, is methyl or ethyl).

Preferably $R_a$, when $C_{1-4}$alkyl, is in an ortho position to the —NH bridging group.

Preferably $R_{1a}$ is in a position ortho to the —NH bridging group.

Preferably $R_{2a}$, when $C_{1-4}$alkyl, is meta to the —NH bridging group and ortho to $R_{1a}$.

Oxanilides of formula I are described in British Published Patent Application No. 2,085,001A and British Patent 1,234,128, the contents of which are incorporated herein by reference along with the contents of corresponding U.S. Pat. Nos. 4,412,024 and 3,906,041.

The stability constant $K_{MA}$ of a complexing agent with copper is described in Organic Sequestering Agents-Chaberek and Martell-John Wiley & Sons (1959) pages 297–343. These pages are incorporated herein by reference.

Preferably where a metal and complexing agent have more than one $K_{MA}$-value, the $K_{MA}$-value referred to in this Specification is that for the metal and the complexing agent in a medium at pH from 4 to 5.5 (preferably at a temperature of 20° to 40° C.).

Dyeing assistants generally used with acid dyes, such as ethoxylated alkylene diamines, for example N-behenyl-1,3-propylene-diamine 105 ethyleneoxide or ethoxylated alkylene monoamines or sulphated ethoxylated alkylene amines can be used in a process according to the invention.

Preferably component c is applied by exhaust dyeing or pad steam continuous dyeing, more preferably by exhaust dyeing in a bath having a liquor to goods ratio of 2:1 to 60:1 at an elevated temperature.

Preferably components a) and b) are applied together as an after-treatment by padding, or at the same time as the dye in the dyebath by exhaustion or by pad-steam continuous dyeing.

Preferably the temperature of an exhaust dyeing according to the invention is from 60° to 135° C.

Preferably the pH of the dyeing is acid, more preferably 4.0 to 7.0.

Further, according to the invention, there is provided an aqueous dispersion comprising a) 90–20% of one or more oxanilides; and b) 10 to 80% of one or more copper salts and/or complexes of a complexing agent having a $K_{MA}$-value of 1.5 to 20, based on the total combined weights of components a) and b).

Preferred dispersions are those containing between 20 and 40%, more preferably about 30% total combined components a) and b), based on the total weight of the dispersion.

Preferably in a dispersion according to the invention 1 to 5%, more preferably about 3% of a dispersing agent, more preferably a formaldehyde naphthalene sulphonic acid condensate dispersing agent is present.

The invention will now be illustrated by the following Examples in which all percentages are by weight of substrate tested except where otherwise indicated and all temperatures are in °C. The dispersions of U.V. absorber contain 3% formaldehyde naphthalene sulphonic acid condensate dispersing agent.

EXAMPLE 1

The following mixtures of dyes were made up:

Dye Mix 1:
1.0% of C.I. Acid Blue 80.
Dye Mix 2:
4.0% C.I. Acid Blue 280—
0.65% C.I. Acid Green 40—
Dye Mix 3:
0.14% C.I. Acid Orange 80—
0.03% C.I. Acid Red 404
0.04% C.I. Acid Black 222.
Dye Mix 4:
0.072% C.I. Acid Orange 80—
0.068% C.I. Acid Blue 193
0.04% C.I. Acid Black 222.

A 5 g sample of a nylon yarn is dyed at 100° for 45 minutes in a dyebath at pH 5.5 at a liquor to goods ratio of 20:1 containing:
1% ammonium sulphate
0.5% of a commercially available behenyl-1,3propylene diamine ethoxylate; and
Dye Mix 3.

The dyed material is then padded to 67% of its weight with a 3% solution to leave on the fabric 2% (or 4.5% solution to leave 3%) by weight of the following dispersion (defined in this Example as "The Dispersion")

64% of a commercially available dispersion (30% actives) of the compound of formula 1a:

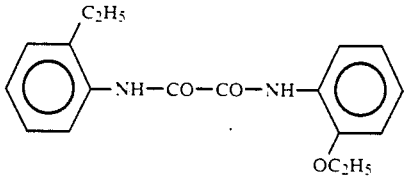

(1a)

26.75% Gluconic acid (50%)
4.75% Cupric Chloride; and
4.50% Sodium Acetate.

"The Dispersion" is made up at pH 4.2 by dissolving the cupric chloride in gluconic acid, adding the sodium acetate which is allowed to dissolve. The dispersion of the compound of formula Ia is then added. After padding, the material is dried at 100° C. and heat set for 30 seconds at 180° C. Alternatively the material may be padded with dye solution containing the Dispersion and steamed for 15 minutes at atmospheric pressure followed by rinsing and drying.

Dyeings having good light fastness and fibres having good stability to light result. Further dyeings can be repeated using 2% and 3% of the Dispersion by weight of polyamide added to the bath.

The dyeings are then compared in the following light test with the dyed nylon yarn that has not been treated with the dispersion.

The dyed yarn shows the following strength loss after exposure to a HANAU SUNTEST machine for 72 hours as follows:

TABLE

| Sample | Loss in Strength |
|---|---|
| Dyed yarn with no addition of "The Dispersion" | 40% strength loss |
| Dyed yarn treated with 2% of "The Dispersion" | 12% strength loss |
| Dyed yarn treated with 3% of "The Dispersion" | 8% strength loss |

TABLE-continued

The loss in yarn strength shows the degree of improved stability to light of nylon yarns.

Similar results can be achieved by substituting one of Dye Mixes 1, 2 and 4 for Dye Mix 3 in the Example above.

Improvements in light fastness can be illustrated by the following results by comparison to the Grey Scale.

(a) Jaguar Test—72 hours exposure in the Hanau "Suntest" machine. (This machine has no temperature or humidity control).

| Treatment | Dye Mixture 1 | 2 | 3 | 4 |
|---|---|---|---|---|
| (a) None | 2 | 2-3 | 2-3 | 2 |
| (b) 2% Dispersion Exhaustion | 4 | 4 | 4 | 4-5 |
| (c) 3% Dispersion Exhaustion | 4-5 | 4 | 4-5 | 4-5 |
| (d) 2% Dispersion Padded | 4 | 4 | 4-5 | 4 |

(b) General Motors Test—Atlas Ci65 machine using a Borosilicate glass filter. The machine operates on alternate light and dark cycles (3.8 hours light, 1 hour dark). During the light cycle the air temperature is 65° C. at 50% R.H. with a black panel temperature at 89° C. During dark cycles air temperature 38° C., RH 100%, the test is run until 220K. Joules radiation energy are used (about 1 week).

| Treatment | Dye Mixture 3 | 4 |
|---|---|---|
| (a) None | 1 | 1 |
| (b) 2% Dispersion Exhaustion | 4-5 | 4-5 |
| (c) 3% Dispersion Exhaustion | 4 | 4-5 |

Example 1 is repeated using, instead of the Dispersion, Dispersion A as follows:
68.5% of the compound of formula 1a
25% gluconic acid (50%)
1.5% cupric chloride dihydrate; and
5% sodium acetate Dye mixes 1, 3 and 4 are used and the following results occur under Test a) the Jaguar Test:

| Treatment | Dye Mixture 1 | 3 | 4 |
|---|---|---|---|
| (a) None | 2 | 1-2 | 1-2 |
| (b) 1% Dispersion A Exhaustion | 3-4 | 3-4 | 4.0 |
| (c) 2% Dispersion Exhaustion | 3-4 | 4.0 | 4.0 |

EXAMPLES 2 TO 5

Example 1 is repeated using, instead of "The Dispersion" of Example 1, one of the dispersions below together with Dye Mix 3.

EXAMPLE 2

Dispersion:
64% of a dispersion in water of the compound of formula 1a
4.75% of cupric chloride
14% of citric acid;
the balance being made up with water to 100%.

EXAMPLE 3

Dispersion:
64% of a dispersion in water of the compound of formula 1a
4.75% of cupric chloride; and
10% of tartaric acid
the balance being made up with water to 100%.

EXAMPLE 4

Dispersion:
64% of a dispersion in water of the compound of formula 1a
4.75% of cupric chloride; and
7.5% of glycollic acid (70%)
the balance being made up with water to 100%.

EXAMPLE 5

Dispersion:
64% of a dispersion in water of the compound of formula 1a
4.75% of cupric chloride; and
15% of glycollic acid (70,)
the balance being made up with water to 100%.

Examples 2 to 5 can be repeated using any one of Dye Mixes 1, 2 or 4 in place of Dye Mix 3.

EXAMPLES 6 to 10

Examples 1 to 5 can be repeated using instead of the dispersion of the compound of formula 1a, the same % of a dispersion of the compound of formula 5a

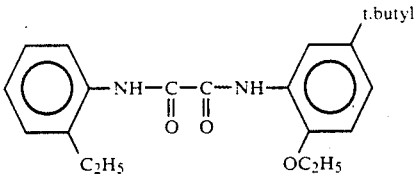

(5a)

Nylon with good stability to light as well as good light fastness properties result.

What is claimed is:

1. A process for dyeing polyamide which comprises applying thereto the following components a), b) and c):

a) one or more oxanilide U.V. absorbers;
b) one or more copper complexes of α-hydroxy-$C_{2-6}$ alkylene carboxylic acids; and
c) one or more metal-free acid dyes and/or metal complex dyes.

2. A process according to claim 1, in which the total amount of components a) and b) present is 0.2 to 2% based on the weight of polyamide present.

3. A process according to claim 1, in which component a) is a compound of formula I

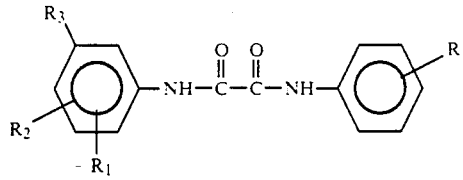

(I)

in which $R_1$ and $R_2$ independently are selected from hydrogen, $C_{1-12}$alkyl, $C_{1-12}$alkoxy, $C_{1-12}$alkylthio, phenoxy and phenylthio;
$R_3$ is hydrogen or $C_{1-8}$alkyl; and
R is hydrogen or $C_{1-12}$alkyl or $C_{1-12}$alkoxy.

4. A process according to claim 3 wherein $R_1$ and $R_2$ are not both selected from alkylthio, phenoxy and phenylthio.

5. A process according to claim 4 wherein $R_3$ is hydrogen.

6. A process according to claim 1 wherein any metal complex dye as component c) is a 1:2 metal complex of an acid dye.

7. A process according to claim 1 wherein component c) is applied by exhaust dyeing or by pad-steam continuous dyeing.

8. A process according to claim 1 wherein component c) is applied by exhaust dyeing in a bath having a liquor to goods ratio of 2:1 to 60:1 at a temperature of 60° to 135° C.

9. A process according to claim 1 wherein component b) is a copper complex of citric, gluconic, tartaric, glycolic or saccharic acid.

10. A process according to claim 3 wherein component b) is a copper complex of citric, gluconic, tartaric, glycolic or saccharic acid.

11. A process according to claim 10 wherein the total amount of components a) and b) present is 0.2 to 2%, based on the weight of polyamide present.

12. A process according to claim 11 wherein 90 to 20% of component a) and 10 to 80% of component b) are present based on the total combined weights of components a) and b).

13. A process according to claim 12 wherein component c) is applied by exhaust dyeing or by pad-steam continuous dyeing and components a) and b) are applied together as an aftertreatment by padding or at the same time as the dye in the dyebath by exhaustion or by pad-steam continuous dyeing.

14. A process according to claim 13 wherein any metal complex dye as component c) is a 1:2 metal complex of an acid dye.

15. A process according to claim 3 wherein 90 to 20% of component a) and 10 to 80% of component b) are present, based on the total combined weights of components a) and b), and the total amount of components a) and b) present is 0.2 to 2%, based on the weight of polyamide present.

16. A process according to claim 15 wherein component c) is applied by exhaust dyeing or by pad-steam continuous dyeing and components a) and b) are applied together as an aftertreatment by padding or at the same time as the dye in the dyebath by exhaustion or by pad-steam continuous dyeing.

17. A process according to claim 3 wherein component c) is applied by exhaust dyeing or by pad-steam continuous dyeing and components a) and b) are applied together as an aftertreatment by padding or at the same time as the dye in the dyebath by exhaustion or by pad-steam continuous dyeing.

18. A process according to claim 3 wherein component a) is a compound of formula Ia

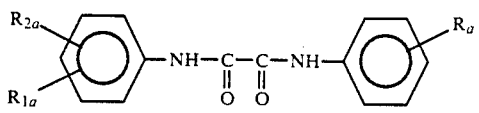

(Ia)

in which $R_{1a}$ is ethoxy or methoxy;

$R_{2a}$ is hydrogen or $C_{1-4}$alkyl; and $R_a$ is hydrogen or $C_{1-4}$alkyl.

19. A process according to claim 18 wherein component b) is a copper complex of citric, gluconic, tartaric, glycolic or saccharic acid.

20. A process according to claim 19 wherein 90 to 20% of component a) and 10 to 80% of component b) are present, based on the total combined weights of components a) and b), and the total amount of components a) and b) present is 0.2 to 2%, based on the weight of polyamide present.

21. A process according to claim 20 wherein component c) is applied by exhaust dyeing or by pad-steam continuous dyeing and components a) and b) are applied together as an aftertreatment by padding or at the same time as the dye in the dyebath by exhaustion or by pad-steam continuous dyeing.

22. A process according to claim 21 wherein component c) is applied by exhaust dyeing in a bath having a liquor to goods ratio of 2:1 to 60:1 at a temperature of 60° to 135° C.

23. A process according to claim 18 wherein, in formula Ia, $R_{2a}$ is $R_{2a}'$ where $R_{2a}'$ is hydrogen or tertiary butyl and $R_a$ is $R_a'$ where $R_a'$ is methyl or ethyl.

24. A process according to claim 18 wherein, in formula Ia, $R_a$, when C1-4 alkyl, is ortho to the —NH bridging group;

$R_{1a}$ is ortho to the —NH bridging group; and $R_{2a}$, when $C_{1-4}$ alkyl, is meta to the —NH bridging group and ortho to $R_{1a}$.

25. A process according to claim 24 wherein component b) is a copper complex of citric, gluconic, tartaric, glycolic or saccharic acid and any metal complex dye as component c) is a 1:2 metal complex of an acid dye.

26. A process according to claim 25 wherein 90 to 20% of component a) and 10 to 80% of component b) are present, based on the total combined weights of components a) and b), and the total amount of components a) and b) present is 0.2 to 2%, based on the weight of polyamide present.

27. A process according to claim 26 wherein component c) is applied by exhaust dyeing or by pad-steam continuous dyeing and components a) and b) are applied together as an aftertreatment by padding or at the same time as the dye in the dyebath by exhaustion or by pad-steam continuous dyeing.

28. An aqueous dispersion comprising a) one or more oxanilide UV absorbers and b) one or more copper complexes of α-hydroxy-$C_{2-6}$ alkylene carboxylic acids, said dispersion containing 90 to 20% of a) and 10 to 80% of b) based on the total combined weights of a) and b).

29. An aqueous dispersion according to claim 28 wherein component a) is a compound of formula I

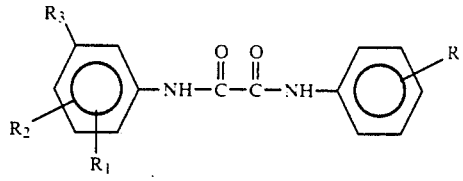

(I)

in which $R_1$ and $R_2$, independently, are selected from hydrogen, $C_{1-12}$alkyl, $C_{1-12}$alkoxy, $C_{1-12}$alkylthio, phenoxy and phenylthio;

$R_3$ is hydrogen or $C_{1-8}$alkyl; and

R is hydrogen or $C_{1-12}$alkyl or $C_{1-12}$alkoxy.

30. An aqueous dispersion according to claim 29 which contains between 20 and 40% combined components a) and b), based on the total weight of the dispersion.

31. An aqueous dispersion according to claim 29 wherein component b) is a copper complex of citric, gluconic, tartaric, glycolic or saccharic acid.

32. An aqueous dispersion according to claim 31 which contains between 20 and 40% combined components a) and b), based on the total weight of the dispersion.

33. An aqueous dipsersion according to claim 29 wherein component a) is a compound of formula Ia

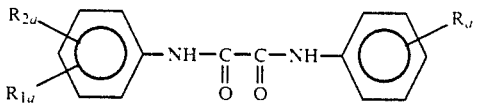

(Ia)

in which $R_{1a}$ is ethoxy or methoxy;

$R_{2a}$ is hydrogen or $C_{1-4}$ alkyl; and $R_a$ is hydrogen or $C_{1-4}$ alkyl.

34. An aqueous dispersion according to claim 33 wherein component b) is a copper complex of citric, gluconic, tartaric, glycolic or saccharic acid.

35. An aqueous dispersion according to claim 34 wherein, in formula Ia, $R_a$, when $C_{1-4}$ alkyl, is ortho to the —NH bridging group;

$R_{1a}$ is ortho to the —NH bridging group; and $R_{2a}$, when $C_{1-4}$ alkyl, is meta to the —NH bridging group and ortho to $R_{1a}$.

36. An aqueous dispersion according to claim 35 which contains between 20 and 40% combined components a) and b), based on the total weight of the dispersion.

37. An aqueous dispersion according to claim 33 wherein component a) is a compound of formula

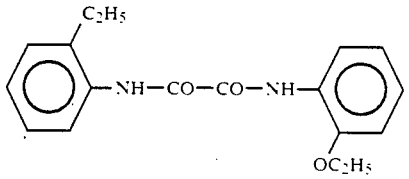

or

-continued
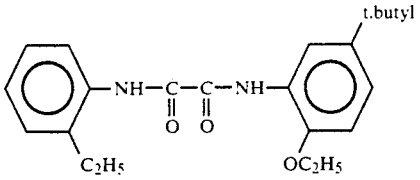
38. An aqueous dispersion according to claim 37 wherein component b) is a copper complex of gluconic acid.
39. Polyamide that has been treated by a process according to claim 1.
* * * * *